US005211616A

United States Patent [19]

Riley, Jr.

[11] Patent Number: 5,211,616

[45] Date of Patent: May 18, 1993

[54] WEIGHT LIFTING BAR APPARATUS

[76] Inventor: Gordon A. Riley, Jr., 3301 Mall Ct., Apt. C8, Michigan City, Ind. 46360

[21] Appl. No.: 818,255

[22] Filed: Jan. 8, 1992

[51] Int. Cl.[5] ..... A63B 21/072

[52] U.S. Cl. ..... 482/106

[58] Field of Search ..... 482/93, 104, 106, 108, 482/109, 110

[56] References Cited

U.S. PATENT DOCUMENTS

| | | | |
|---|---|---|---|
| 1,333,055 | 3/1920 | Warner | 482/110 |
| 3,384,370 | 5/1968 | Bailey et al. | 482/106 |
| 4,455,020 | 6/1984 | Schnell | 482/106 |
| 4,461,473 | 7/1984 | Cole | 482/106 |
| 4,585,229 | 4/1986 | Brasher | 482/106 |
| 4,618,143 | 10/1986 | Twardosz | 482/106 |
| 5,024,434 | 6/1991 | Smith | 482/106 X |

FOREIGN PATENT DOCUMENTS

| | | | |
|---|---|---|---|
| 223926 | 6/1985 | German Democratic Rep. | 482/108 |

*Primary Examiner*—Robert Bahr

*Attorney, Agent, or Firm*—Leon Gilden

[57] ABSTRACT

A weight lifting bar has a plurality of hand grip portions rotatably mounted relative to the bar to include an outer ring fixedly mounted to the bar, with the outer ring diametrically aligned relative to the bar, with an inner ring rotatably mounted relative to the outer ring capturing a layer of bearings between the outer ring and the inner ring. A modification of the invention includes a hand grip bar mounted within the inner ring apertured to direct powder rosin therethrough to enhance grasping of the bar during use.

4 Claims, 4 Drawing Sheets

WEIGHT LIFTING BAR APPARATUS

BACKGROUND OF THE INVENTION

1. Field of the Invention

The field of invention relates to weight lifting apparatus, and more particularly pertains to a new and improved weight lifting bar apparatus wherein the same is arranged for the ease of manipulation of a weight lifting bar and accommodation of individuals gripping of the bar during rotation of the bar in use.

2. Description of the Prior Art

In the sport of weight lifting, bar bells arranged to lift various weights are utilized, wherein various types of bars such as curling bars are configured of a bent portion to accommodate various grasping orientations of an individual's manual grasping of the bar. Prior art structure to provide for a ring organization to accommodate grasping of a bar in a selective manner is set forth in U.S. Pat. No. 4,618,143 to Twardoz wherein a weight lifting bar includes an inner ring latchable relative to an outer ring in grasping of a bar structure.

U.S. Pat. No. 4,787,629 to Demyer sets forth a weight lifting bar utilizing self-contained weight mounts secured to the bar.

U.S. Pat. No. 4,274,628 to Hoagland sets forth a weight lifting bar utilizing a plurality of bar members projecting medially of the bar for positioning about an individuals neck portion during use.

As such, it may be appreciated that there continues to be a need for a new and improved weight lifting bar apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of weight lifting bar structures now present in the prior art, the present invention provides a weight lifting bar apparatus wherein the same utilizes a plurality of grasping rings freely rotatably mounted relative to an outer ring relative to each inner ring to permit continuous accommodation and adjustment of an individual's grasping of the associated bar structure. As such, the general purpose of the present invention, which will be described subsequently in greater detail, is to provide a new and improved weight lifting bar apparatus which has all the advantages of the prior art weight lifting apparatus and none of the disadvantages.

To attain this, the present invention provides a weight lifting bar with a plurality of hand grip portions rotatably mounted relative to the bar to include an outer ring fixedly mounted to the bar, with the outer ring diametrically aligned relative to the bar, with an inner ring rotatably mounted relative to the outer ring capturing a layer of bearings between the outer ring and the inner ring. A modification of the invention includes a hand grip bar mounted within the inner ring apertured to direct powder rosin therethrough to enhance grasping of the bar during use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved weight lifting bar apparatus which has all the advantages of the prior art weight lifting apparatus and none of the disadvantages.

It is another object of the present invention to provide a new and improved weight lifting bar apparatus which may be easily and efficiently manufactured and marketed.

It is a further object of the present invention to provide a new and improved weight lifting bar apparatus which is of a durable and reliable construction.

An even further object of the present invention is to provide a new and improved weight lifting bar apparatus which is susceptible of a low cost of manufacture with regard to both materials and labor, and which accordingly is then susceptible of low prices of sale to the consuming public, thereby making such weight lifting bar apparatus economically available to the buying public.

Still yet another object of the present invention is to provide a new and improved weight lifting bar apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
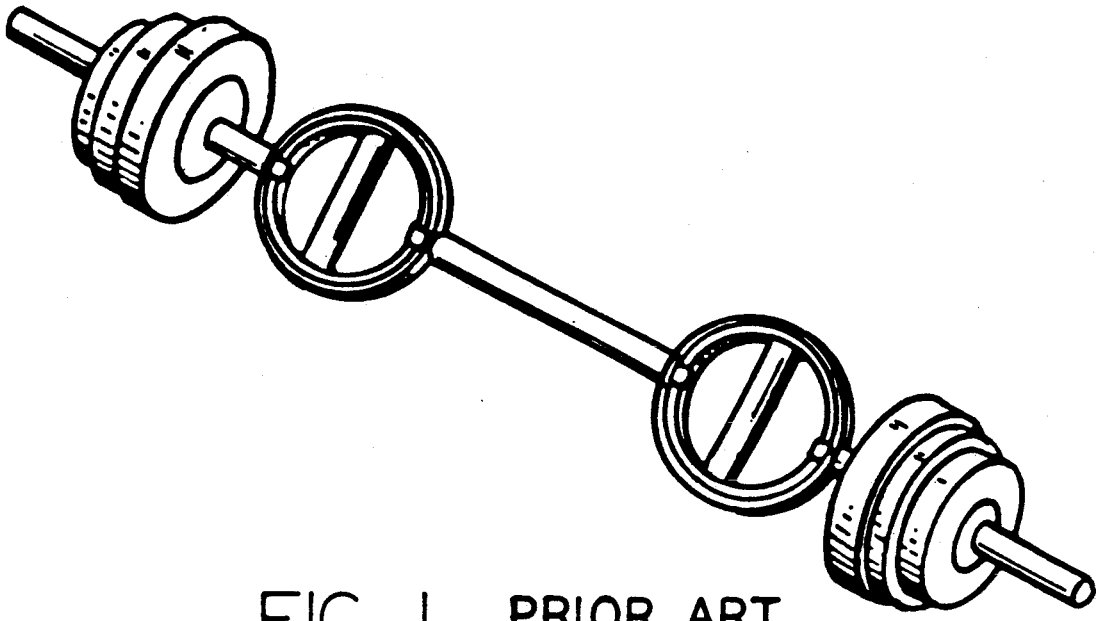
FIG 1 PRIOR ART
FIG. 1 is an isometric illustration of a prior art weight lifting bar structure.

With reference now to the drawings, and in particular to FIGS. 1 to 8 thereof, a new and improved weight lifting bar apparatus embodying the principles and concepts of the present invention and generally designated by the reference numeral 10 will be described.

Figure 2:
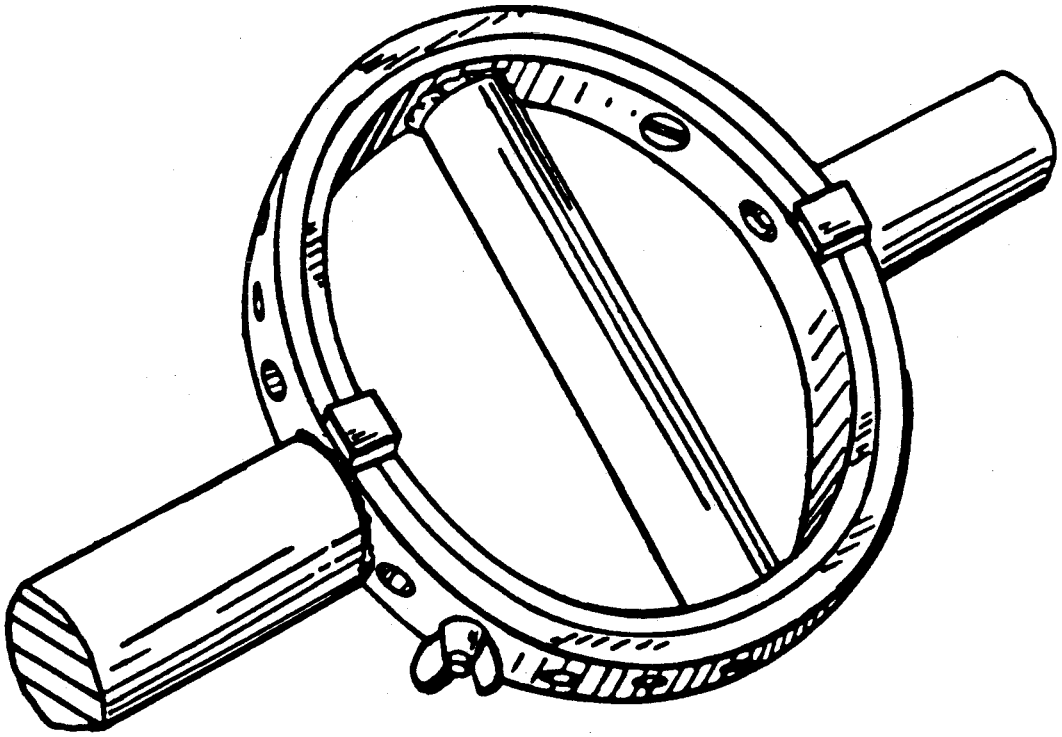
FIG 2 PRIOR ART
FIG. 2 is an enlarged isometric illustration of the weight lifting bar structure in the prior art as set forth in FIG. 1.
Figure 3:
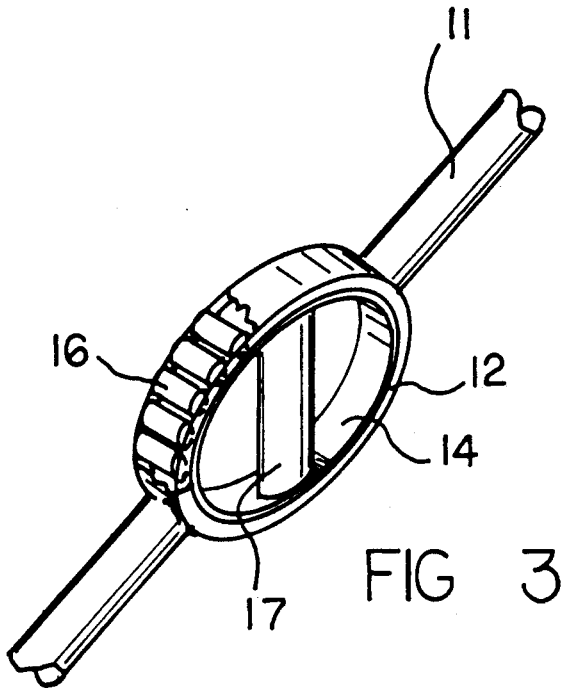
FIG. 3 is an isometric partial sectional view of an inner ring structure mounted to the outer ring structure of the instant invention.
Figure 4:
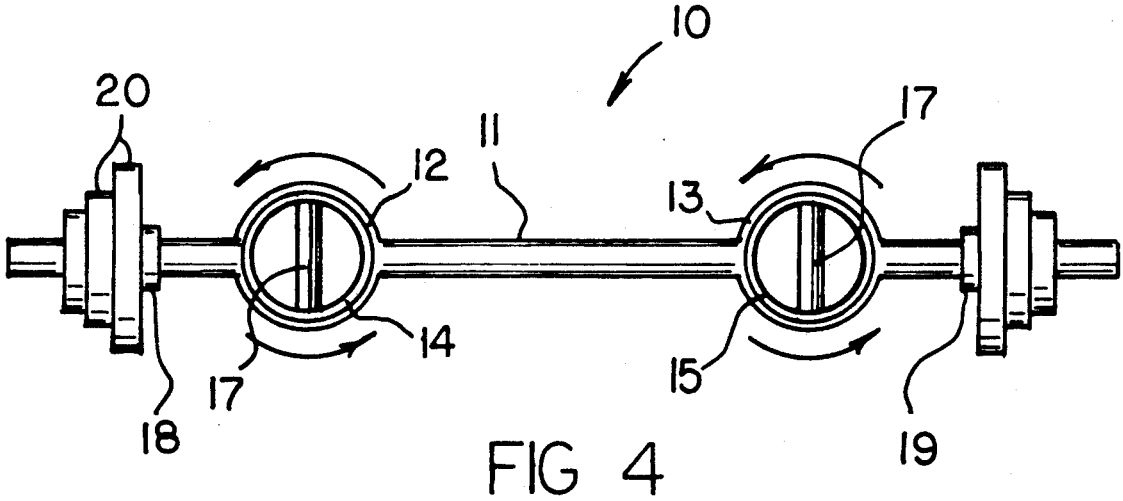
FIG. 4 is an orthographic frontal view of the bar structure of the invention.

FIGS. 1 and 2 illustrate a prior art weight lifting bar structure as set forth in the U.S. Pat. No. 4,618,143, wherein the inner ring is arranged for selective latching relative to an outer ring in the grasping of the weight lifting bar structure.

More specifically, the weight lifting bar structure 10 of the instant invention essentially comprises a central bar 11 longitudinally aligned to include respective first and second outer rings 12 and 13 fixedly mounted to the central bar in a spaced relationship relative to one another, with the central bar 11 diametrically intersecting the outer rings 12 and 13. Each outer ring is equally spaced from respective first and second distal ends of the central bar 11, with the first and second distal ends respectively mounting a respective first and second inner collar plate 18 and 19 thereto. The first and second outer rings 12 and 13 rotatably mount a respective first and second inner ring 14 and 15 concentrically within the respective first and second outer rings 12 and 13. The inner and outer rings each include a set of coextensive bearings 16 mounted in an interfacing relationship between the inner and outer rings in a manner as exemplified in the FIG. 3. Removable weight discs 20 are mounted to the central bar 11 exteriorly of the collars along bar extensions of the bar 11. Further, an inner ring bar 17 is fixedly and diametrically mounted within each inner ring 14 and 15 respectively to provide for manual grasping of the inner ring relative to the central bar 11.

Figure 5:
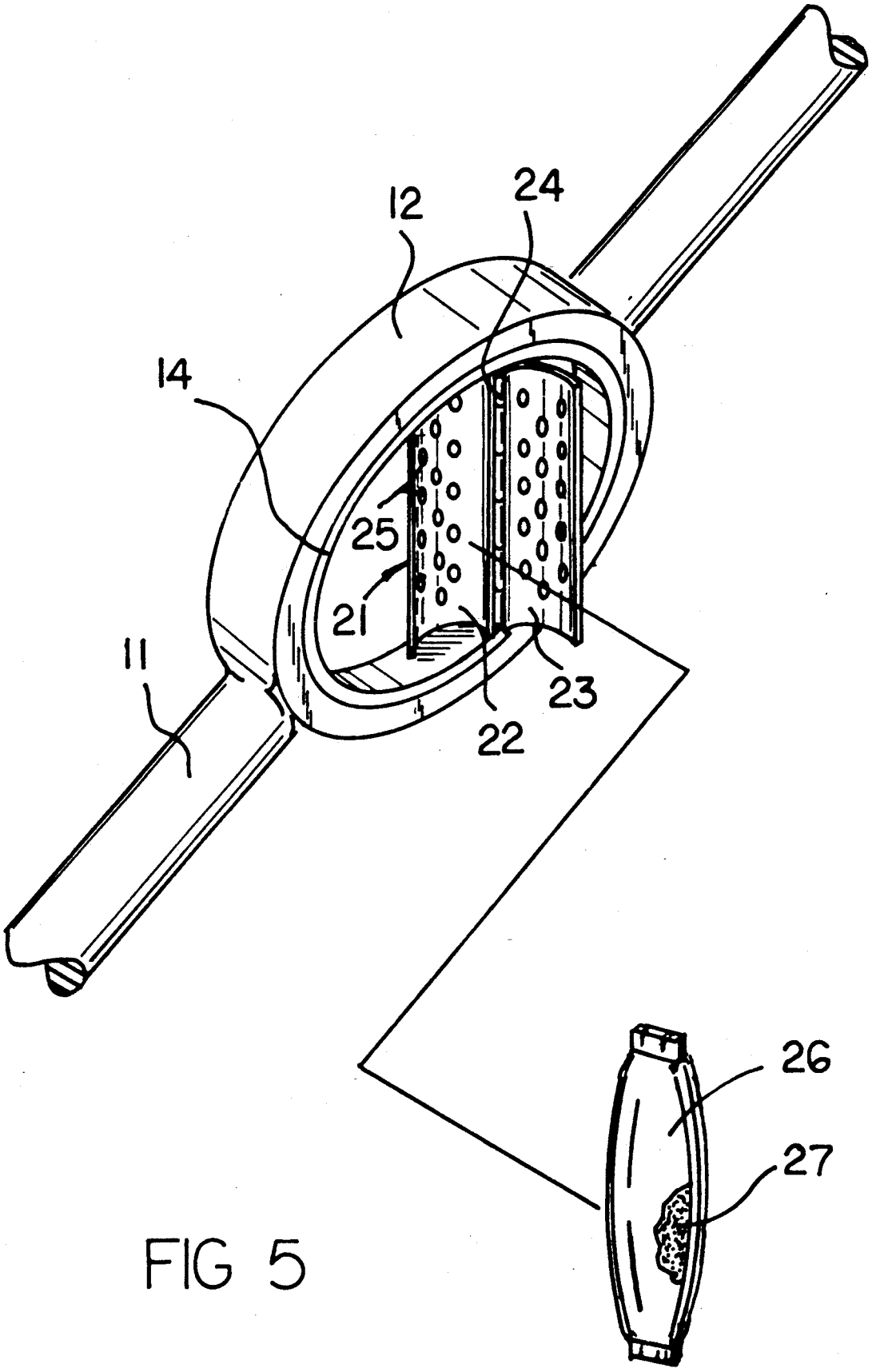
FIG. 5 is an isometric illustration of a modified rasping ring structure of the invention.

The FIG. 5 illustrates a modified inner ring bar 21 mounted in lieu of each inner ring bar 17, wherein each inner ring bar 21 includes a first semi-cylindrical tube 22 fixedly mounted diametrically within the respective inner ring, with a second semi-cylindrical tube 23 hingedly mounted about a tube hinge 24. Each of the first and second semi-cylindrical tubes 22 and 23 are arranged to include a matrix of apertures 25 directed therethrough. A porous bag member 26 is therefore arranged for reception between the semi-cylindrical tubes 22 and 23, wherein each porous bag member 26 is filled with powdered rosin 27 for projection onto an individual's hands through the apertures 25 to assist in grasping of the bar structure during use.

Figure 6:
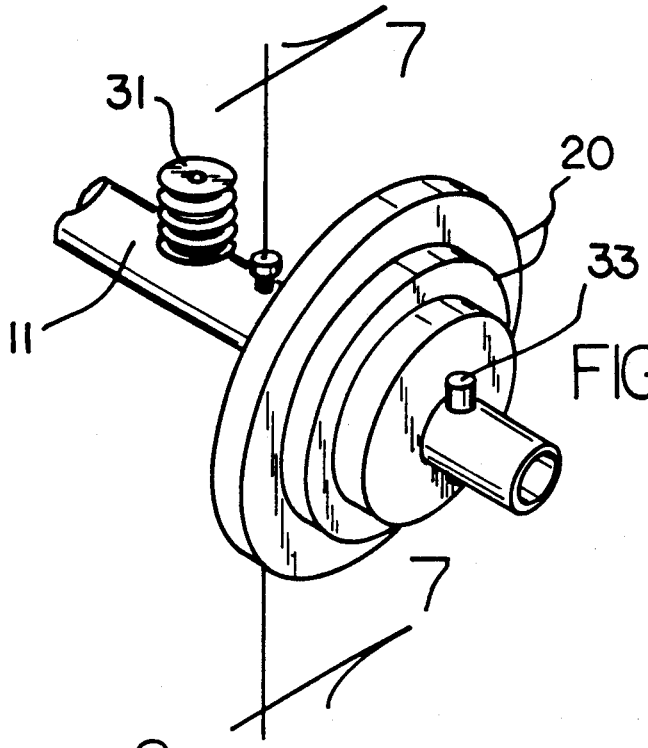
FIG. 6 is an isometric end view of the bar structure utilizing a clamping organization relative to the plate members.
Figure 7:
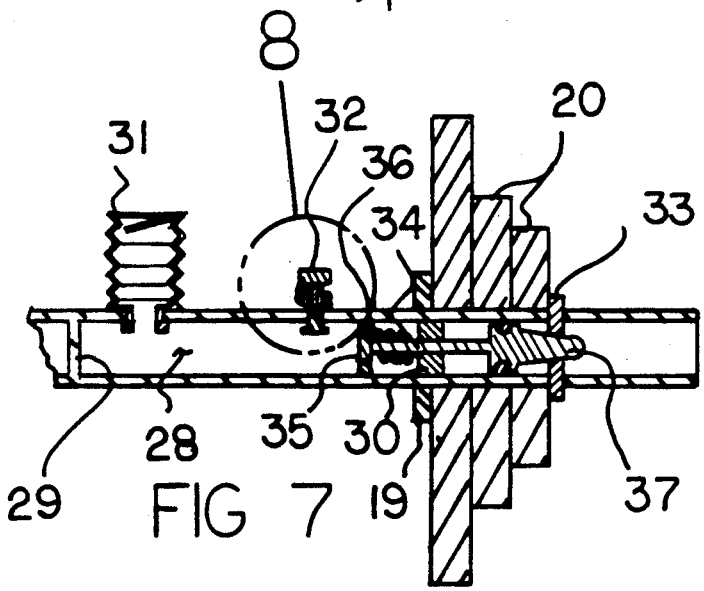
FIG. 7 is an orthographic view, taken along the lines 7—7 of FIG. 6 in the direction indicated by the arrows.
Figure 8:
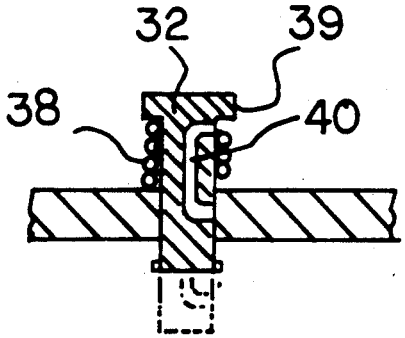
FIG. 8 is an orthographic view of section 8 as set forth in FIG. 7.

The FIGS. 6–8 illustrate the invention utilizing a clamping structure that is mounted relative to a central bar tubular chamber 28 that is oriented between a first web 29 within the central bar 11 and a spaced second web 30 positioned adjacent the associated collar plate of each distal end of the bar 11. A pneumatic pump member 31 of a diaphragm construction is mounted in pneumatic communication with the chamber 28, with pressure directed therewithin released through a vent valve 32, to be described in more detail below. A lock pin 33 of a split configuration is mounted through the extended end portions of the bar 11 exteriorly of the weight discs 20. The lock pin 33 slidably mounts upon a conical head 37 mounted to a forward distal end of a lock rod 34, with a rear distal end of the lock rod 34 fixedly mounting a piston 35 sealingly arranged within and in sliding relationship with an interior portion of the chamber 28. The lock rod spring 36 captured between the piston 35 and the second web 30 normally biases the conical head 37 towards the second web 30 upon release of pressure within the chamber 28. Pressurizing the chamber 28 effects displacement of the conical head 37 relative to the second web 30 to project the lock pins 33 radially and exteriorly of the central bar extended end portions to thereby secure the discs 20 between the collar 18 or 19 and the associated lock pin 33.

A vent head 39 is reciprocatably mounted within the central bar 11 in pneumatic communication with the chamber 28, with a vent conduit 40 directed through the vent valve 32. A vent spring 38 is captured between the vent head 39 and the bar 11 to normally bias the vent valve 32 in a raised orientation to position the vent conduit 40 and its lower outlet above the chamber, whereupon projection of the vent valve 32 within the chamber effects pneumatic communication of the chamber 28 exteriorly thereof for venting the chamber and release of the lock pins 33.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A weight lifting bar apparatus, comprising, a central bar, the central bar including a first distal end spaced from a second distal end, the first distal end including a first collar mounted adjacent the first distal end, with the second distal end including a second collar mounted adjacent the second distal end, and the central bar including a first and second outer ring fixedly mounted to the central bar between the first collar and the second collar, wherein the first outer ring and the second outer ring are mounted and secured to the central bar, and each outer ring includes an inner ring rotatably and freely mounted concentrically oriented relative to and within the respective first and second outer ring, and a plurality of individual bearing members mounted between each outer ring and each inner ring, and each inner ring includes a bar diametrically mounted fixedly within each inner ring, and each bar includes a first semi-cylindrical tube fixedly mounted within each inner ring, and each first semi-cylindrical tube includes a second semi-cylindrical tube hingedly and pivotally mounted relative to the first semi-cylindrical tube, and a porous bag member received between the first semi-cylindrical tube and the second semi-cylindrical tube, and the first semi-cylindrical tube and the second semi-cylindrical tube including a matrix of apertures directed therethrough, and powder resin contained within the porous bag.

2. An apparatus as set forth in claim 1 wherein the central bar includes a pneumatic chamber positioned within the central bar adjacent each outer ring, and each chamber positioned between a first web and a second web, the second web including a lock rod slidably mounted to the second web, the lock rod including a forward distal end exteriorly of the chamber, wherein the forward distal end includes a conical head mounted thereto, the conical head slidably receiving a plurality of pins diametrically mounted relative to the conical head, and a rear distal end of the lock rod including a piston slidably received within the chamber, the piston in sealing engagement within the chamber, and a pneumatic pump means mounted to the central bar above the chamber in pneumatic communication with the chamber to effect selective pneumatic pressurizing of the chamber, and vent means mounted in pneumatic communication with the chamber to effect selective venting of pressurizing of the chamber.

3. An apparatus as set forth in claim 2 wherein the vent means includes a vent head, the vent head including a vent spring mounted between the vent head and the central bar, and each vent member includes a vent conduit, including a first conduit end and a second conduit end, wherein the first conduit end is displaced from the chamber in a first raised position and projected within the chamber in a second displaced position.

4. An apparatus as set forth in claim 3 including a lock rod spring captured between the second web and the lock rod piston to normally bias the lock rod piston within the chamber.

* * * * *